United States Patent [19]

Hamilton

[11] Patent Number: 4,912,371

[45] Date of Patent: Mar. 27, 1990

[54] POWER SAVING FLUORESCENT LAMP SUBSTITUTE

[76] Inventor: William L. Hamilton, P.O. Box 175, Painesville, Ohio 44077

[21] Appl. No.: 315,604

[22] Filed: Feb. 27, 1989

[51] Int. Cl.[4] ..... H05B 39/00; H05B 41/14; H05B 41/16; H05B 41/24

[52] U.S. Cl. ..... 315/95; 315/250; 315/312; 315/324; 315/363; 315/121; 315/122; 315/227 R; 315/228

[58] Field of Search ..... 315/224, 312, 95, 363, 315/250, 71, 75, 88, 94, 119, 121, 122, 125, 126, 187, 227 R, 228, 229, 231, 312, 363, 250, 324

[56] References Cited

U.S. PATENT DOCUMENTS

| | | | |
|---|---|---|---|
| 2,680,236 | 6/1954 | Kuebler | 339/145 |
| 2,774,917 | 12/1956 | Passmore | 315/189 |
| 3,727,104 | 4/1973 | Neal et al. | 315/256 |
| 3,956,665 | 5/1976 | Westphal | 315/95 |
| 3,993,386 | 11/1976 | Rowe | 339/50 R |
| 4,053,811 | 10/1977 | Abernethy | 315/95 |
| 4,102,558 | 7/1978 | Krachman | 339/144 R |
| 4,211,958 | 7/1980 | Bickford et al. | 315/312 |
| 4,255,692 | 3/1981 | Burgess | 315/312 |
| 4,348,614 | 9/1982 | Burgess | 315/250 |
| 4,475,064 | 10/1984 | Burgess | 315/187 |
| 4,736,138 | 4/1988 | Masaki | 315/224 |

*Primary Examiner*—Eugene R. LaRoche
*Assistant Examiner*—Michael B. Shingleton

[57] ABSTRACT

An improved non-lighting fluorescent lamp substitute to replace one lamp in a two-lamp series connected circuit so that the circuit is completed through the remaining lamp allowing it to light, whereas without the lamp substitute, the circuit is incomplete if one lamp is removed and then the other lamp is unable to light. In one form, the device is wired into a light fixture, while in another form, it looks like a conventional fluorescent lamp and fits into the sockets of the fixture. Either form cuts power consumption substantially in half with a corresponding reduction in light output. The improvement is a triac in the device that limits the magnitude of the effective arc current by phase angle control to the original design current of the lamp and ballast in order to achieve the normally expected life of the lamp and ballast. Electrical insulation is provided on the tips of the bi-pin terminals to reduce shock hazard to installers, and in one species, a twin-triac arrangement eliminates any possibility of shock to an installer.

20 Claims, 4 Drawing Sheets

POWER SAVING FLUORESCENT LAMP SUBSTITUTE

FIELD OF THE INVENTION

The invention disclosed here is an improved non-lighting fluorescent lamp substitute for use in common two-lamp series connected fluorescent light fixtures. One type is made to be wired into existing fixtures while another type looks like a conventional lamp and fits into sockets of a fixture. This latter type is often called a "phantom tube" or a "dummy tube". Either type replaces one lamp of a pair so that it completes the series circuit while producing no light of itself. It reduces both the light output of the fixture and the electrical power input to about one half of that of a standard two lamp fixture. It can be used with both rapid start circuits and instant start circuits as well as a variety of types of ballast.

BACKGROUND OF THE INVENTION

Fluorescent lamps give more lumens of light per watt of electricity than incandescent lamps. So they have replaced incandescents in many fields, and hundreds of millions of installations are in use throughout the world. After World War II, a decline in the overall cost of fluorescent lighting caused it to be used freely at substantial foot candle levels in offices, stores and factories. However, the abrupt rise in the cost of energy in the early 1970's caused building managers, illumination engineers and architects to re-think the amount of light needed for various activities. What were previously deemed desireable levels of lighting now seemed lavish and too costly. Buildings that had been planned before the energy crunch were being described as "over-lamped". And ways were being sought to reduce the electrical consumption even if the previous lighting levels had to be sacrificed. And to some degree, at least, lighting levels could be reduced without harm, as in corridors and work areas where local task lighting could supplement a lower general light level. All at a reduction in electrical load.

To meet these changed conditions, lamp manufacturers developed lamps with somewhat lower wattage to work with existing ballasts. And ballast manufacturers brought out energy saving ballasts for new fixtures or replacement. Phantom tubes were invented that enable one lightable lamp to be removed from a two lamp fixture with a saving in power.

At the present time, another great set of problems has arisen in the energy industry. Although the cost of fuels has leveled off---even declined at least for some indefinite period---the cost of expanding power plant capacity has become almost prohibitive. Important factors being:

1. Public opposition to nuclear power plants has delayed their construction while fixed costs such as interest on financing continue, delays or not.

2. Fossil fuel plants, both existing and planned, are being forced by law to reduce stack emissions, often at great expense. Although this is socially desireable, it discourages expansion of power producing capacity.

3. Demand by consumers for reasonably priced electricity continues to rise, especially for air conditioning which causes extreme peak loads on hot days.

4. To carry short-time peak loads, many power plants have added gas turbine generators. Simple to install and noted for rapid start-up compared to steam plants, they are ideal for this service. But their higher fuel cost makes them too expensive to carry the base load at which large steam plants still excel. In many areas, this "fix" has been carried as far as practical.

So now, conservation is again being sought to bring electrical consumption more into line with the capacity of existing power systems. In many parts of the United States, cash incentives are being given by power companies, both public and investorowned, to consumers for installing power conserving devices. Some such plans pay for each energy reducing fluorescent tube or ballast that replaces a standard tube or ballast. Others offer rebates per kilowatt-hour for the rated life of energy saving equipment.

The invention here is such an energy-saving device and can save a building management approximately half the electrical power normally used for every fluorescent light fixture so fitted, in addition to the incentives that might be offered by the power company for the conversion. The reduced heat output of the fixtures can also save on the building air conditioning load. It does this without the shortened life of lamps or ballast experienced with similar devices in the prior art. And the conversion is as simple as relamping existing fixtures.

Even though the amount of power saved in one fluorescent fixture is small, when multiplied by even a small percentage of existing fixtures, the total saving in a large building and to the country can be great. So by the use of this device, consumers are benefited, power companies in their present situation are benefited, and the environment is helped by holding emissions to present levels, all in proportion to the number of phantom tubes in use.

BRIEF DESCRIPTION OF THE PRIOR ART

Two of the most commonly used fluorescent circuits are the two-lamp series connected *rapid start* and the similar two-lamp series connected *instant start*. If a building manager wanted to reduce the electrical load in a building equipped with either of these types, it would appear at first glance that he could remove one lamp of each pair to reduce power input and light output of the fixture. But since the lamps in these two-lamp arrangements are in series and operate from one ballast, removal of either lamp breaks the circuit and puts the other lamp out. Inventors have recognized this and offered solutions that are presently in commercial use.

U.S. Pat. No. 3,956,665, Westphal, replaces one lamp with a wire connection and a capacitor. To avoid the cost of a licensed electrician to re-wire the fixture as well as leave a pair of empty sockets, Westphal places the capacitor in a tube that simulates a standard lamp and can be installed in the same sockets. Although it does not light, it enables the remaining standard lamp to light. But unless the capacitor is unduly large, the impedance of the capacitor reduces the light output to significantly less than one half of the original two lamps. The power factor of the fixture is greatly improved, however, and that was the goal of the inventor.

U.S. Pat. No. 4,053,811, Abernethy, discloses a lamp simulator that looks like a standard fluorescent lamp, but is not intended to light. Instead, it has a direct wire connection, end-to-end, which completes the circuit when it is used in place of one of a pair of lamps in a two-lamp series circuit. Like Westphal, Abernethy circumvents the necessity of rewiring the fixture by making the connection in the guise of a non-lighting "lamp".

These lamp simulators have come to be known generically as "phantom lamps" or "phantom tubes" or "dummy tubes" from their obvious non-function. At first glance, it might not be apparent why these devices save any power with one lamp since the current may be even greater than with two lamps. But the voltage drop across the combination is approximately one half. And so the power of "amps times volts" is approximately one half. And this is reflected back through the primary of the ballast transformer to the power line.

U.S. Pat. No. 4,211,958, Bickford et al, increases the safety of the direct wire phantom with magnetically actuated switches in the circuit. This breaks the electrical continuity in the situation where the installer inserts one end of the tube into an energized socket, twists the tube 90 degrees so that the bi-pins contact the pole pieces in the socket, and then inadvertently touches the pins on the other end. If his body is grounded, a lethal shock of fairly high voltage can occur. Only when the tube is in both sockets with Bickford's device is there a complete circuit. And it is important to note that in corridors without windows, the installer will almost invariably "work hot" rather than provide temporary work light from some other source. Although it is extremely unlikely that an installer would insert only one end of the tube and twist it 90 degrees into contact, it might happen. And there is an obsolete type of push-in socket that makes it easier to do it wrong.

The same danger exists with a standard fluorescent lamp, but it has been ignored in commercial practice.

However, U.S. Pat. No. 4,102,558, Krachman, proposes an insulating end cap slipped over a specially shaped bi-pin to mitigate this danger.

U.S. Pat. No. 3,993,386, Rowe, discloses what might be called a partial phantom lamp. It consists of a shorter fluorescent lamp of lower wattage along with extender wires to fit in the space normally occupied by a longer higher-wattage lamp. This has the commercial disadvantage that the short tube costs much more than the longer high-production lamp even without the additional cost of the extender. It also spoils the light distribution if used with the retrofit reflectors that are coming onto the market.

While previous inventions in this field have offered laudable solutions and may have accomplished their intended basic purpose, several years of usage have shown the need for improvement. And none of the previous approaches, individually or in combination, suggest the invention described and claimed here.

One of the most basic problems is that the direct-wire phantom tube has negligible electrical resistance, and this works against the electrical characteristics of the ballast in this manner: For an example, the common 4 foot long, 40 watt rapid start lamp operates at standard loading with an apparent resistance of about 230 ohms. The ballast that is specifically designed to operate two of these lamps in series has a nominal design parameter of "working into" a load of 2 times 230 ohms. When a phantom tube having *no* resistance replaces a lamp, the ballast is forced to work into a resistance of only one half of what it was designed for. The current through the ballast and the remaining lamp increases somewhat. The only reason that the direct-wire phantom can work at all is that a ballast is designed, as is well known, to limit current through the lamps even though their resistance changes over a wide range. But the ballast current-characteristic is not perfectly "flat", although newer, well-designed ballasts are very good in this respect. Reducing the load resistance by one half, by completing the series circuit with a direct wire, is great enough to be outside of the design parameters of the ballast. The current passing through the one lightable lamp becomes greater than it would be in the conventional two-lamp circuit. In tests, the lighted lamp opposite the phantom tube can be visually seen with the naked eye to be brighter than it would be when paired with a standard lightable lamp. This increased lumen output results, of course, from the higher arc current through the lamp as a result of the absence of resistance in the direct-wire phantom. Lamp life is thereby shortened as is known from field experience. And the problem is exacerbated whenever actual line voltage is higher than it should be.

The higher current also has an adverse effect on the ballast, but not from what one might expect at first thought. The common "coil and core" type of ballast consists of a laminated iron core with windings of insulated wire along with a capacitor in series for power-factor correction and usually with another capacitor across one lamp as an aid in starting. The components are assembled in a sheet metal case, normally with a potting compound to conduct heat to the outside. Tens of millions of these are in daily use.

It is well known that high temperature, especially in an enclosed fixture, is the commonest factor affecting the life of a ballast, shortening the life of both the insulation of the windings and the dielectric of the capacitors. But surprisingly, the ballast in a phantom tube circuit of the prior art may even run cooler than normal. Since there are no filaments in the typical phantom tube to draw current, one filament winding in the ballast is idling and another is at half current. Also the wattage to the single lightable lamp is less than with two. As a consequence, the case temperature of the ballast may even be lower despite the fact that the current is somewhat higher. So, in instances of ballast failure, the telltale signs of high temperature that investigators look for may not be present.

However, the higher current associated with the direct-wire phantom also increases the voltage across the power-factor-correcting capacitor in the ballast. (The fact that a higher A.C. current through a capacitor produces a higher voltage across the capacitor is a basic electrical phenomenon and is true in any A.C. series circuit. That is, it is not limited to fluorescent lighting circuits.) The higher voltage stresses the capacitor beyond what it was designed for. It explains why many older ballasts seem to suffer quick failure when "working into" a circuit with a phantom tube of the prior art. Perhaps these ballasts are marginal or ready to fail anyway. But since their capacitors were not intended for the increased voltage (derived from the increased current), it is probable that most ballast problems associated with phantom tubes of the prior art are from this cause.

It would be futile, of course, to make a phantom tube having a resistance element in order to hold current to original design levels. A resistance would make a direct IR power loss that would produce no light but only unwanted heat in the resistance. It would be equally unwise to limit the current with an inductive reactance. The resulting lower power factor would be unacceptable due to the greater circulating "non-power" current in the power line.

One object of this invention is to provide an improved phantom tube (also called a lamp simulator) that can replace one lightable lamp in a two-lamp series circuit resulting in a saving in electrical power of about 50 percent for each fixture so fitted.

Another object is to provide an improved phantom tube that limits the effective current through the ballast and the lamp to original design levels in order to attain normal lamp life and normal ballast capacitor life.

A further object is to make a phantom tube that is safer for an installer to insert into energized sockets, even if he handles the tube incorrectly.

Another object is to make a fluorescent lamp substitute that can be wired into a two-lamp series fixture in a simple manner.

Additional advantages and objects will become apparent to those skilled in the art from consideration of the drawings and descriptions.

SUMMARY OF THE INVENTION

The fluorescent lamp substitute of the present invention enables an existing two-lamp fixture to be modified to operate with one lamp instead of the usual two with a 50 percent power saving. A triac and control circuit in the device limits the effective current through the lamp and through the ballast in order to achieve normal expected life of both lamp and ballast with normal lumen output of the lightable lamp.

As is well known, a thyristor such as a triac (or alternately, back-to-back SCR's) can be used in alternating current circuits to control the effective current by delaying the onset of conduction each half cycle to some phase angle later than zero in the first half cycle and later than 180 degrees in the second half cycle. This technique is commonly termed "phase control". Commercial lamp dimmers have used this principle for about two decades to control the light output of both incandescen and fluorescent lamps. With fluorescent lamps, the dimmer typically varies the current to the primary side of the ballast rather than to the lamps themselves. The reason for this is that the ballast when operating at normal line voltage has the built-in characteristic of trying to keep the tube current at its designed level. And so the amount of dimming that is possible with a triac in the *lamp* circuit (the secondary of the ballast) is very limited. If much dimming *is* forced, an oscillation sets in between the inductance of the ballast windings and its power-factor-correcting capacitor which drives the circuit into an unstable pulsing of the lamp.

The present invention operates in this limited range by keeping ballast current at its designed level rather than trying to force the ballast to do something against its designed characteristic.

Note that in this disclosure, the ballasts referred to are "two-lamp series ballasts" because they are so well known. They are designed for use in a two-lamp series circuit. Most two lamp fixtures use this kind and tens of millions of these are in use in the U.S. alone. In a similar way, most four-lamp fixtures merely use two of these two-lamp ballasts, each connected to its own pair of lamps. It will be understood, however, that the fluorescent lamp substitute of this disclosure may also be used in other plural lamp circuits when it is desired to use fewer than the original number of lightable lamps.

The preferred embodiment of this invention is a lamp simulator (phantom tube) that has both the dimensions and the outward appearance of a conventional fluorescent lamp except that the glass might be clear instead of phosphor coated. Other materials such as fiber or transparent plastic could, of course, be used because the transparency of glass or plastic is desireable to allow light from the lightable tube to pass through to the reflector surface of the fixture. However, the lamp substitute need not look exactly like a regular lamp. It might be, for example, an extruded plastic bar having an "X"-shaped cross-section with terminals adapted to fit into lampholders in place of a lightable lamp. While the biggest market is for straight tubes of various lengths, the triac circuit can be used in other configurations.

A second embodiment encapsulates the electronic parts in a package about the size of a postage stamp with two extending wires to be connected inside the fixture. But since most users do not care to open up an overhead fixture, the triac control device is better commercialized in the form of the above-mentioned replacement tube so that it can just be inserted like a lamp by unskilled workers.

Furthermore, the sockets are not empty as with the wired-in species. Empty sockets might entice someone to insert a lightable lamp although there is no harm in doing so, the lamp just will not light.

DETAILED DESCRIPTION OF THE INVENTION

Figure 1:
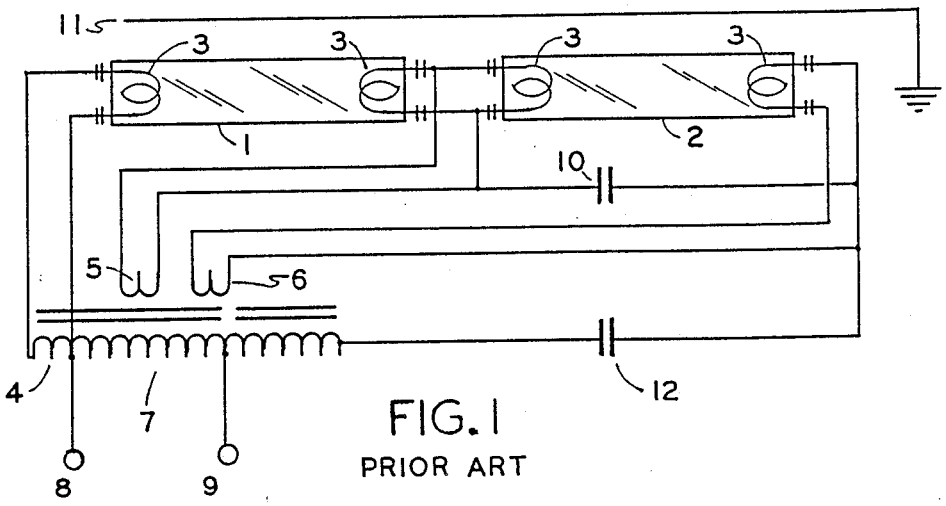
FIG. 1 PRIOR ART
FIG. 1 shows a conventional prior art two-lamp series rapid start fluorescent lamp circuit.

Referring to the drawings in detail, like reference numerals are used to designate like elements in the several figures.

FIG. 1 is a schematic diagram illustrating the prior art rapid start two-lamp series circuit. This widely used arrangement is characterized by fluorescent lamps 1 and 2 that have filaments 3 that are electrically resistance heated both for starting and continuously for running. In the trade, the filaments may also be called "electrodes" or "cathodes". In many lamps, they act alternately as both anode and cathode, but are still commonly called cathodes.

These cathodes are heated from low voltage taps 4, 5 and 6 in the transformer ballast 7 in order to reduce the voltage needed to strike an arc in the gas filled lamps and then while running to extend the useful life of the cathodes.

The ballast, which receives A.C. line voltage from terminals 8 and 9, when first connected, supplies a short high voltage pulse to the lamps in series to strike an arc. At this same instant, capacitor 10 briefly causes most of this voltage from the ballast secondary winding to be applied across lamp 1 to start it first. After lamp 1 starts, its resistance drops markedly and the available voltage then starts lamp 2, the entire start-up taking a second or two. The lamps then operate in series, with the reactance of the ballast continuously limiting the current through the lamps to a designed magnitude. A grounded metal strip 11 in close proximity to the lamps may be needed to facilitate starting under some conditions and is commonly provided by the metallic structure of the fixture. Capacitor 12 in series with the lamps and the ballast desireably increases the power factor by offsetting the inductive reactance of the choke portion of the ballast. Incidentally, in the U.S., it is expected that high power factor ballasts with an adequate amount of capacitance will soon be required by law in new construction as an energy saving means.

In the case where either of the lamps 1 or 2 is removed from the ballast circuit, it can be seen that the series circuit is incomplete. If lamp 2 is omitted, for example, a small current will flow through starting capacitor 10, but not enough to fully light lamp 1. If lamp 1 is removed, lamp 2 will not light at all.

Figure 2:
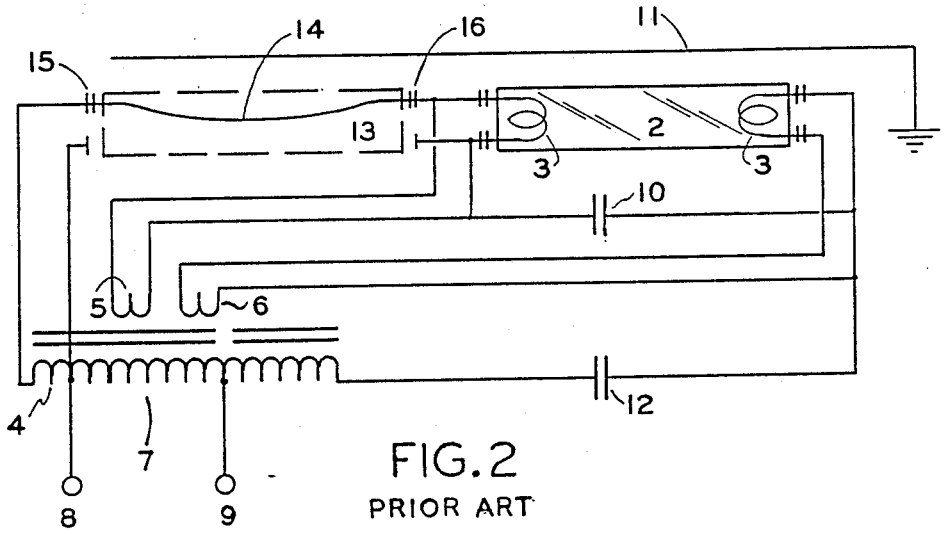
FIG. 2 PRIOR ART
FIG. 2 shows the use of a direct-wire phantom tube of the prior art substituted for one lamp of the circuit of FIG. 1.

However, referring to FIG. 2, if a fluorescent lamp substitute, such as the phantom lamp 13 of U.S. Pat. No. 4,053,811, is used in place of either of the lamps, the ballast secondary circuit is again complete and the single lightable lamp will light, shown here as 2. Note in FIG. 2 that the direct wire connection 14 engages only one socket terminal 15 and 16 on each end, rather than two on each end for the lightable lamp. It can be seen that there are then four possible ways for such a direct-wire phantom to be inserted in the circuit. The phantom tube can be twisted 180 degrees about its longitudinal axis to contact either set of the bi-pin socket terminals, or the phantom can be installed in either lamp location. The difference in light output and in the power reduction of the fixture varies somewhat for each of these choices, but is not substantial. In any case, the previously cited disadvantages of the direct-wire phantom persist.

The fluorescent lamp substitute of this invention can likewise be substituted in a similar manner for either lightable lamp of the pair in this type of rapid start circuit.

Figure 3:
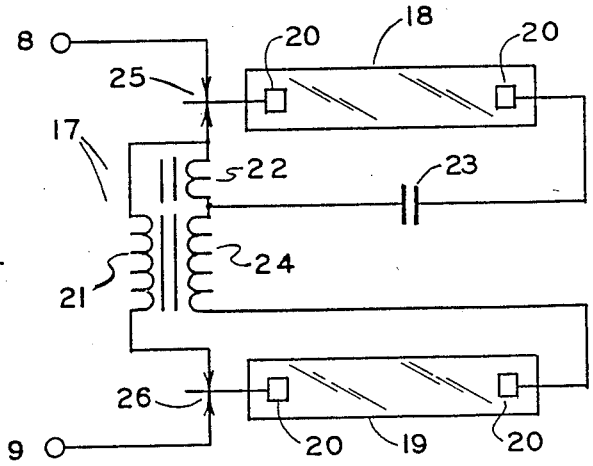
FIG. 3 PRIOR ART
FIG. 3 shows a conventional prior art two-lamp series instant start circuit.

FIG. 3 is a schematic diagram of a prior art instant start two-lamp series circuit. This arrangement is characterized by unheated electrodes 20 that require a high striking voltage to initiate the mercury vapor arc in the gas filled lamps 18 and 19. The arc then heats the electrodes to some extent while running. Only a single pin terminal is required on each end of the lamp. These lamps start in sequence a few milliseconds apart which, of course, appears to the eye to be instantaneous. The primary winding 21 of ballast 17 is energized by A.C. line voltage at terminals 8 and 9. The secondary winding 24, auxiliary winding 22 and capacitor 23 co-act to give a high starting voltage first to one lamp, then almost instantaneously to the other lamp. Because of the danger from the high voltage, disconnect sockets 25 and 26 (symbolized by arrow heads) are customarily used to remove power from the transformer primary when one or both lamps are removed from their sockets. The lamp substitute of this invention, provided with compatible end terminals, may be used in place of either lightable lamp in this instant start circuit.

Figure 4:
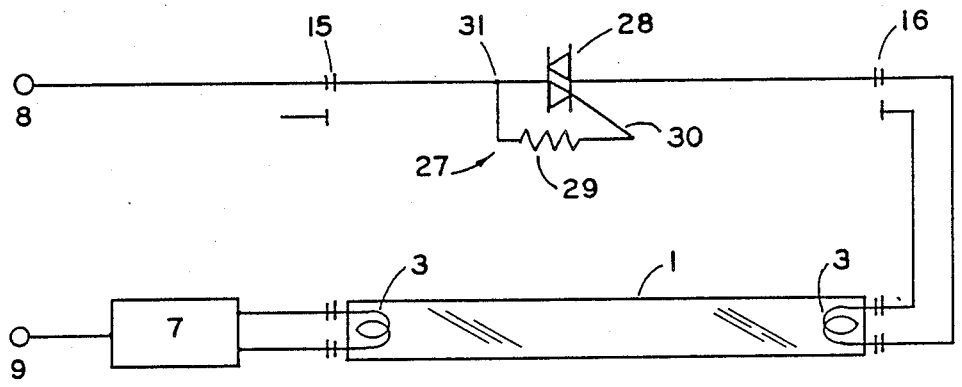
FIG. 4 shows a circuit of the present invention simplified for clarity by omitting the internal details of the ballast and the cathode heating circuitry.

FIG. 4 shows a rapid start two-lamp series circuit such as in FIG. 1 with the lamp substitute 27 of this invention used in place of one lightable lamp. For clarity, the internal details of ballast 7 and the cathode heating circuitry have been omitted but would be the same as in FIG. 1. The lamp substitute uses a bi-directional controllably conductive device (thyristor) which is preferrably a triac 28 connected between socket terminals 15 and 16. It will be obvious to those skilled in the art that the triac could be replaced by equivalent bi-directional controllably conductive devices such as oppositely poled SCR's or an internally triggered triac, sometimes called a "quadrac".

The triac here has a triggering means 29 (can also be called a "gating means") connected to its gate terminal 30. This is shown in FIG. 4 as a resistor, also being connected to one main terminal 31 of the triac. Instead of a resistor, gating means 29 can be a small capacitor or an inductor with good results. But the resistor is obviously the most economical.

The triac 28, or similar device, is used in known fashion to allow conduction through lamp 1 during a portion of each A.C. half cycle by means of phase control. That is, the onset of conduction is delayed to some phase angle later than zero electrical degrees in the first half cycle and later than 180 electrical degrees in the second half cycle. Only when the gate 30 reacts to the rising voltage coming through trigger means 29 near the beginning of each half cycle does the triac fire and conduct current through the lamp. At the end of each half cycle, the triac becomes non-conductive, in known fashion, less than a millisecond after the current drops to zero, and is then ready to "delay start" itself in the reverse direction on the next half cycle.

As cited earlier, the *effective* current through one lamp can thus be limited to a value commensurate to the original designed current for two lightable lamps in series by controlling the phase angle delay of the triac simply by selecting a suitable value for gating means 29, whether it be a resistor, capacitor or inductor.

Figure 5:
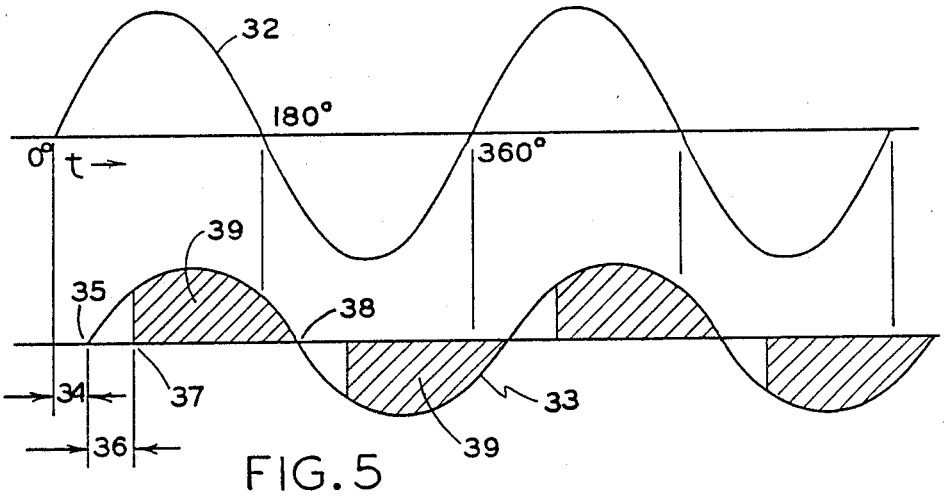
FIG. 5 illustrates phase angle control by a triac or other thyristor using idealized wave forms.

FIG. 5 illustrates the above process graphically. Although the voltage curve 32 across the triac and the current curve 33 through the triac are shown as sine waves for simplicity of illustration, it is known that a gas discharge device such as a fluorescent lamp greatly distorts both voltage and current wave shapes.

If the power factor of the circuit is slightly lagging, as it usually is in practice, there will normally be a time displacement 34 of the current behind the voltage. If the phantom circuit had a direct wire instead of a triac, current through the lightable lamp would begin at point 35. But with the triac phantom of this invention, there is a designed-in delay for the onset of conduction in the amount of the phase control angle represented by the linear distance 36 so that conduction begins at point 37. The delay 36 is determined by the value of resistor, capacitor or inductor of the triggering means.

It is well known in the triac art that the current does not actually rise instantaneously at turn-on, as shown, and that there is some overshoot that causes oscillations in the current waveform. The triac ceases to be conductive for the half cycle as current becomes zero at point 38. The shaded area 39 under the current curve represents the effective current through the lamp for the half cycle, and it can be seen to be less than the current would be if the triac began conduction at point 35. In like manner, the triac controllably conducts current in the reverse direction on the next half cycle of 180 degrees to 360 degrees.

From a cost standpoint, it may be pointed out that the "rated blocking voltage" of the triac need not be full peak voltage of the circuit. Unlike most other control circuits employing thyristors, the triac here always turns on well before the peak voltage is reached, and so then the voltage across it becomes essentially zero. In practice, a variety of triac types could be used, but some are lower in cost because of large volume production for other purposes. In the practice of this invention, a triac with commercial designation "Motorola MAC 97-6 824" has been used for a fixture with 40 watt rapid start lamps having a normal current of 430 milliamps. Gating resistor 29 can be a low-cost single turn variable resistor to trim the circuit during manufacture to match the characteristics of a particular type of ballast. Or an even lower cost fixed resistor of ¼ watt size can be used, since some deviation or spread of final results can be allowed. In tests, resistors in the range of 1 ohm to 4700 ohms have been used with good results in connection with a standard ballast, that is to say, a ballast not of the so-called "energy-saving type". The higher resistor values result in lower current flow, less lumen output of the lightable lamp and lower power input. But this also produces more radio-frequency interference (RFI). The lower values of resistor allow the triac to react earlier in each half cycle and allow more effective current to flow through the lamp, but reduce RFI.

To suppress the RFI in the above example, an inductor of 100 microhenrys can be inserted in series with the triac. When this combination is used as a substitute for lamp 2 in FIG. 1, an interesting co-action takes place with existing capacitor 10 (which is actually encased in ballast 7) to produce an "inductive-capacitive network". This acts as a filter and greatly reduces the RFI. On the other hand, when such a phantom tube circuit is used in place of lamp 1 of FIG. 1, the benefit is not as great. But with the amount of phase control needed to accomplish the goals of this invention, little RFI is produced and the above described suppression circuit would rarely be needed.

In the example above, instead of a resistor for gating means 29, a capacitor in the range of 0.05 microfarads to 1 microfarad can be used. Smaller values than this can make hard starting of the lamp with some ballasts and under some conditions. In the example of practice above, the voltage rating of such a capacitor need only be about 50 volts because the triac fires below this voltage in the cycle and then there is substantially no voltage across the triac or the capacitor. An inductor of 100 millihenrys has also been used as a gating means.

The particular values selected for these circuit elements are dependent on the specific results desired and it is well within the scope of those skilled in the art to select appropriate values. The range of values mentioned above are not to be considered limitations and it will be understood that other components would be selected to work with fixtures of different voltage or current ratings.

Triacs have a characteristic, frequently unrecognized, that is particularly useful in this application. If a voltage transient occurs that exceeds its rated blocking voltage, the triac avalanches into conduction (self fires). Unless the current is greater than its short-time rating, no harm is done. Such transients frequently occur on power lines and can occur here if someone removes the lightable lamp while it is on. Transients may also occur when the light fixture is turned on or off. Tests show that these events pose no problem.

Figure 6:
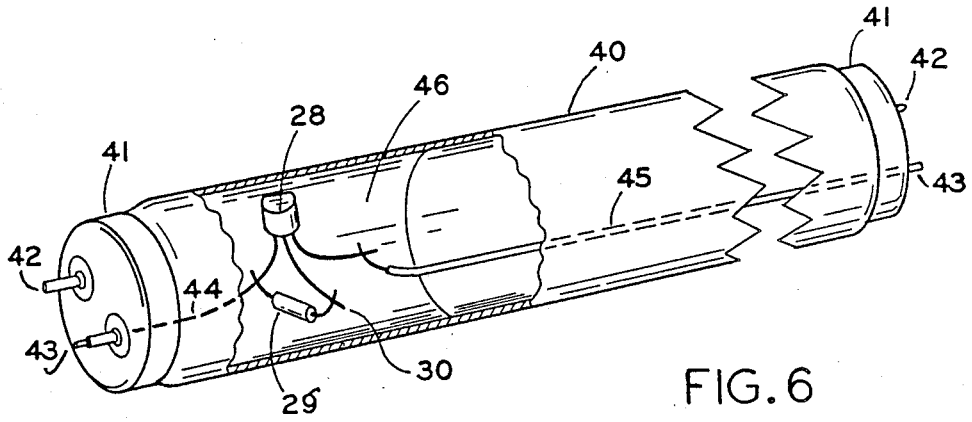
FIG. 6 shows a cut-away view of a fluorescent lamp simulator in the form of a phantom tube containing the elements of the present invention.

FIG. 6 shows the lamp simulator in the form of a phantom tube having substantially the size and shape of a standard fluorescent lamp. The tubular body 40 itself is preferrably a transparent material such as clear glass although it could be other suitable material, there being no internal vacuum or enclosed gas. End caps 41 are similar to the end caps of a standard lightable tube and have terminals 42 and 43 to engage the sockets (also called lampholders in the trade) of a fixture for mechanical support and electrical connection. As shown in this figure, the phantom tube with bi-pin terminals would be suitable for a rapid start fixture. Other end terminations are provided to fit other types of lampholders, for example, a single pin on each end for an instant start fixture. Triac 28 and resistor gating means 29 are connected the same as in FIG. 4 and have wires 44 and 45 extending the length of the tube to connect electrically with one of the bi-pins on each end. Optional item 46 is an aluminum foil sleeve about 2 inches (5 cm.) long wrapped around inside one end of the tube. It provides a place for patent number and printed instructions on its outer surface that can be viewed through the transparent material. It also hides the electronic parts from view and can provide a heat sink if the triac is cemented to it.

Bi-pin 42 is a standard pin as used in the lamp industry, but is not electrically connected. Bi-pin 43 is also a standard pin but is modified at assembly to allow for a thin layer of hardenable electrical insulating compound to be applied to its tip as a precaution against electric shock to an installer.

Figure 7:
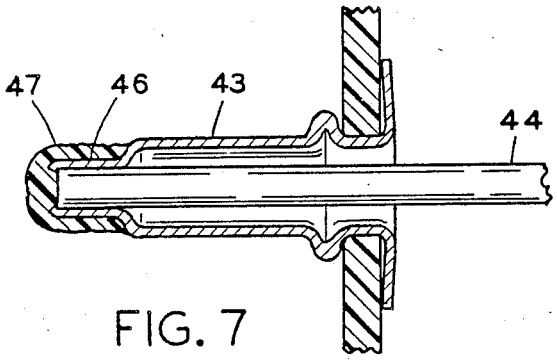
FIG. 7 shows an enlarged sectional view of one bi-pin terminal having an electrically insulated tip to minimize risk of electric shock during installation.

FIG. 7 shows an enlarged sectional view of such a pin. During manufacture, the outer end or tip 46 of hollow pin 43 is mechanically crimped onto wire 44. This achieves both an electrical continuity between pin and wire and a reduced outside dimension of the pin. Then, just the tip of the pin, as part of an end cap subassembly, is dipped vertically into a liquid insulating material such as an epoxy or an insulating varnish of proper viscosity to form a small blob or covering 47. Instead of dipping, a measured amount of liquid material can just be dabbed onto the tip of the pin in a very simple manner and allowed to flow over the end.

This insulation, when hardened, does not interfere with electrical contact to the lampholder terminal because the changed dimension from the crimping process allows for the thickness of the coating. The crimped portion of the pin need not be round and it need not be concentric with the rest of the pin. It must only be moved in a direction relative to the rest of the pin to make room for the thin layer of insulation on the side that contacts the lampholder terminal. And the insulation itself need not be concentric with the pin.

During installation of the lamp simulator into a light fixture, the insulated tip does lessen the risk that an accidental touch on the end of the pin will contribute to an electrical shock. This insulated tip can be used on the bi-pin terminal of any kind of phantom tube including those of the prior art. But instant start tubes do not need it due to the aforementioned safety sockets that disconnect the primary of the ballast until both ends of the tube are engaged in their respective sockets.

With bi-pins of standard length in the U.S. of 5/16 inches (7.9 mm), an insulated length of ⅛ inch (3.25 mm) is satisfactory.

U.S. Pat. No. 2,680,236, Kuebler shows a method of crimping a hollow pin termination onto a wire passing through it to make an electrical connection. This is widely used today in the production of rapid start lamps but does not anticipate the dual result of crimping only the tip of a bi-pin terminal in such a way that it can be insulated with a conformable coating without affecting the electrical contact of the pin with a socket terminal.

The method here of crimping the tip of the pin onto the wire achieves these two results with one operation; electrical connection and providing space in a radial direction for the layer of insulation. A specially shaped pin and a special end cap subassembly are not needed as in the prior art. The lamp industry's standard end cap and standard bi-pins can be used to real economic advantage. These are manufactured at extremely low cost for use on millions of fluorescent lamps and can be used here without modification until the aforementioned crimping operation. And using a simple daub of liquid insulation material replaces the separate molded part of the prior art which must be assembled, probably by hand. An overall lower cost is achieved.

Even with rapid start phantom tubes having bi-pins without insulation, the danger of shock is extremely small. An identical hazard has existed for decades with regular lightable tubes and has been ignored by the lighting industry. For the installer to receive a shock, all of the following things must happen simultaneously, whether using a phantom tube or a lightable tube:

Work with an energized fixture
Be grounded, as by touching the fixture
Insert only one end of the tube into a socket
Twist the tube 90 degrees into contact with socket terminals
Touch the pins on the other end of the tube. (With a phantom, only one pin may be electrically connected.

But because phantom tubes are not yet widely known, there is a greater perceived hazard than with lightable tubes. So from the standpoint of market acceptance as well as consumer protection, it is desirable to make phantom tubes as safe as possible.

Figure 8:
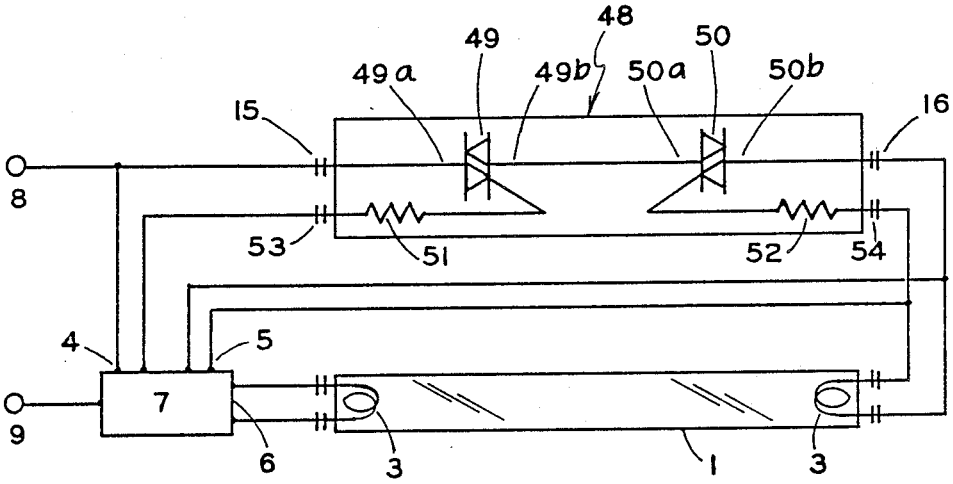
FIG. 8 shows a phantom tube circuit wherein two triacs in series eliminate shock hazard even from inappropriate touching of bi-pin terminals during installation.

FIG. 8 shows a safety circuit with even greater shock protection for use in the form of a phantom tube 48 to be used in rapid start circuits. Two triacs 49 and 50 are used in series. For clarity in the figure, the internal details of the ballast are omitted, but would be the same as in FIG. 1. The two triacs can be identical but need not be. For absolute safety each triac must have a "rated blocking voltage" (breakover voltage) higher than the highest peak voltage that could occur in the circuit, including any inductive kick from the ballast. In this respect, the triacs differ from those of previously described circuits in this disclosure which can have lower blocking voltage rating. Triac 49 has one main terminal 49*a* connected (through bi-pin, not shown) to lampholder terminal 15. Similarly, triac 50 has main terminal 50*b* connected (through bi-pin, not shown) to lampholder terminal 16. Main terminals 49*b* and 50*a* are connected to each other.

The gate of each triac is connected to its respective triggering resistor 51 and 52 which, in turn, are connected (through bi-pins, not shown) to lampholder terminals 53 and 54. Thus, the gate of each triac is connected to the cathode heating windings 4 and 5 of the ballast 7 at its respective end of tube 48. These windings typically put out 4 to 5 volts open circuit, which is enough to trigger the triacs. However, it is really the arc voltage which passes through the heater windings that triggers the two triacs. This is an important point to realize in the actual design of this species because the wires from the heater windings may be reversed at the tube lampholders, one fixture to another, there being no reason to observe polarity in the heater connections in the standard fixture. The heater voltage, then, may add to or subtract from the arc voltage. In any case, both triacs react to the rising arc voltage and fire at or near a selected phase angle, even though they may not be triggered at the exact same instant.

It will be apparent that, during installation, the phantom tube of this construction must be seated in lampholders at both ends before both triacs can be gated into conduction to form an electrical conductor for the lamp current. Even if the installer touches bi-pins on one end of the tube while the other end is inserted into an energized lampholder, the installer cannot receive a shock. All of the other advantages previously cited for a triac phantom tube are also inherent in this design.

Resistors 51 and 52 not only determine the phase angle delay, they are also sized to protect the gates from excessive current, since the portion of the trigger voltage due to the cathode heating circuit does not disappear once the triac fires.

Figure 9:
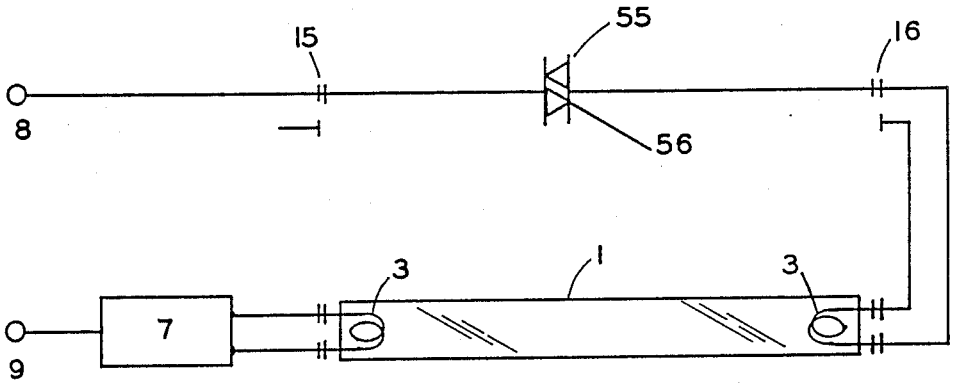
FIG. 9 illustrates an alternate phantom tube circuit with a triac having no triggering means connected to its gate terminal, but uses instead the break-over characteristic of the triac.

FIG. 9 shows a fluorescent lamp substitute circuit of extreme simplicity. Triac 55 is a commercially available type designed for low voltage circuits. One such type has a reverse blocking voltage of only 30 volts. In the event that a higher voltage than this appears across its main terminals, the triac reacts to the rising A.C. voltage by firing even with no gate signal in a "break-over mode".

So in this species, gate terminal 56 is not connected to anything. When the triac "breaks over" in this fashion, its resistance drops to a low value just as it would if gated into conduction. Consequently there is insignificant power loss. At the present time, the triacs for this circuit must be individually selected to actually have the desired working blocking voltage characteristic. But if bought in large enough quantity, the manufacturer would control this characteristic more closely than is presently needed for other applications.

Figure 10:
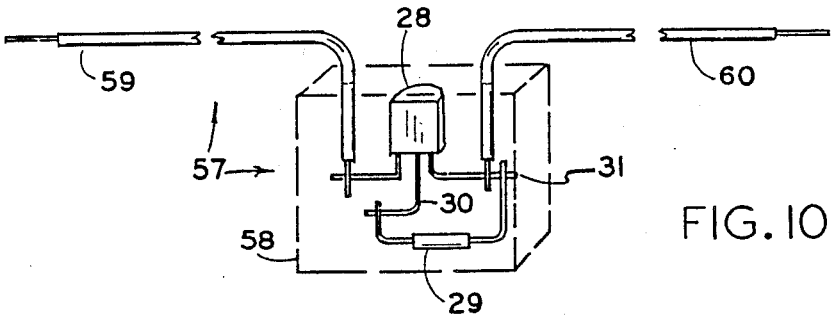
FIG. 10 shows an alternate embodiment for wiring the triac device directly into fixture circuitry for the same purposes already stated.

FIG. 10 shows another embodiment of this invention, a lamp substitute adapted for wiring directly into the circuitry of a fixture, either rapid start or instant start. Lamp substitute 57 has a triac 28 with its gate terminal 30 connected to gate triggering means 29, which is, in turn, connected to main terminal 31 of the triac, all the same as in FIG. 4. Molded plastic block 58 (shown in phantom) or other protective electrical insulation material encapsulates these components and their wire connections. Connected to the two main terminals of the triac and extending from the plastic block are color-coded wires 59 and 60 that indicate to an installer where to connect them in the fixture. Most modern fluorescent lampholders for rapid start circuits make this easy because they have "push-in" connections for the stripped ends of wires to be inserted. Each side of such a lampholder has holes for two wires and fortuitously there are empty holes available in the typical fixture. The wires from the ballast are all color-coded, so the installer of this device need only push the wires 59 and 60 into the lampholders having matching colored wires. For other types of lampholders that may not have push-in connections, wires 59 and 60 are connected to the lampholder wires of corresponding color using "squeeze-on" tap connectors that are presently on the market.

Figure 11:
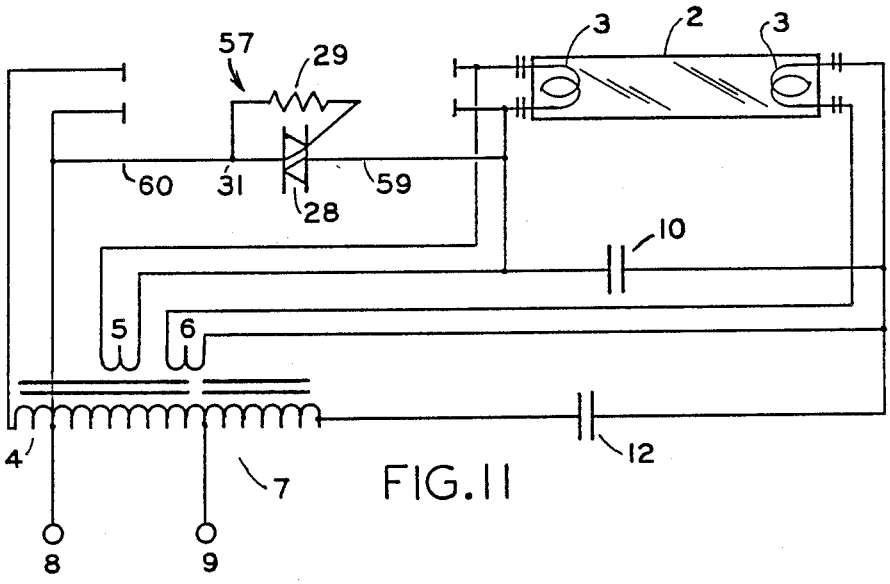
FIG. 11 shows how the device of FIG. 10 is connected into circuitry of a fixture.

FIG. 11 shows how the device 57 of FIG. 10 is connected into the circuit of FIG. 1 substituting for lamp 1. Operation is as previously described in detail for FIG. 4 and FIG. 5.

Figure 12:
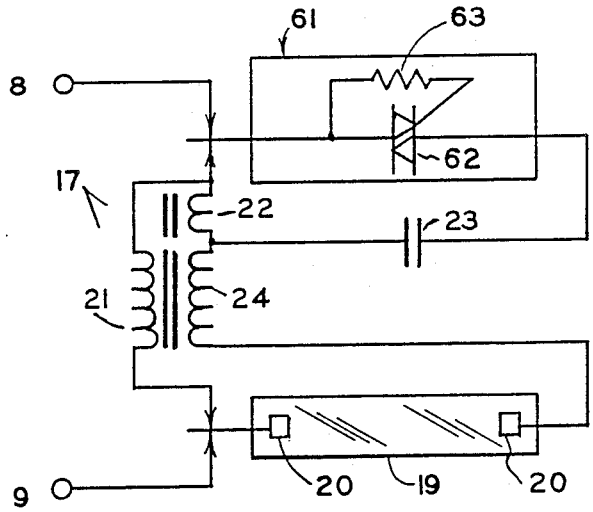
FIG. 12 shows how a triac phantom tube is used in the instant start circuit of FIG. 2.

FIG. 12 shows the triac fluorescent lamp substitute 61 as it is used in the instant start circuit of FIG. 3 substituting for lamp 18. The preferred embodiment is a phantom tube of the same size and shape of the instant start lamp that it replaces with end terminals compatible with instant start lampholders. The triac device operates essentially in the same manner as explained above. For the higher voltages and/or currents associated with instant start circuits, triac 62 has commensurate ratings. Resistor 63 is selected to achieve the amount of phase control to get the desired effective current through lightable lamp 19. That is, the triac reacts to the rising voltage each half cycle through gating resistor 63 and fires at a selected phase angle to conduct only the desired amount of current. Other aspects of the circuit operate as explained for FIG. 3. Gating means can alternately be a capacitor or an inductor.

There has been described and illustrated a novel means of reducing lumen output and power consumption of fluorescent lamps in various arrangements without deleterious side effects on lamp and ballast life and efficiency. Preferred embodiments have been shown but it's expected that variations, substitutions of equivalent components and use in other applications may become apparent to those skilled in the art after considering this specification and accompanying drawings. Therefore, any variations, substitutions and other uses which do not depart from the spirit and scope of the invention are deemed to be covered by the invention limited only by the following claims.

What is claimed is:

1. An improved fluorescent lamp substitute for use in a lighting fixture, said fixture having a ballast circuit normally operable to energize plural fluorescent lamps to produce respective normal lumen outputs at respective arc currents, having respective pairs of lampholders in which terminals of respective lamps may be situated for electrical connection in said ballast circuit and for mechanical support of said lamps, the improvement comprising a bi-directional controllably conductive means for completing at least a portion of said ballast circuit when one of said lamps is removed therefrom thereby to enable said ballast circuit to energize at least one remaining lamp in circuit connection therewith, said bi-directional controllably conductive means limiting said arc current through said remaining lamp to substantially normal effective values to produce substantially normal lumen output of said remaining lamp in order to promote normal lamp life and normal ballast life, said lamp substitute being insertable for electrical connection in said ballast circuit in place of said removed lamp.

2. The improvement of claim 1 wherein said lamp substitute comprises means insertable in a pair of said lampholders from which a lamp has been removed for electrical connection thereto and mechanical support therefrom.

3. The improvement of claim 2 wherein said lamp substitute comprises a tubular body, end terminations complementary to said lampholders of said removed lamp, said bi-directional controllably conductive means having at least two main terminals, and electrical conductors inside of said tubular body electrically connecting said main terminals to said end terminations.

4. The improvement of claim 3 wherein said tubular body comprises transparent material.

5. The improvement of claim 1 wherein said bi-directional controllably conductive means comprises a triac having at least two main terminals and having gating means whereby said triac reacts to increasing voltage each half cycle of alternating current to conduct said arc current through said remaining lamp for only a portion of said half cycle.

6. The improvement of claim 5 wherein said gating means comprises a resistor connected to the gate terminal and one of said main terminals of said triac.

7. The improvement of claim 5 wherein said gating means comprises a capacitor connected to the gate terminal and one of said main terminals of said triac.

8. The improvement of claim 5 wherein said gating means comprises an inductor connected to the gate terminal and one of said main terminals of said triac.

9. The improvement of claim 1 wherein said bi-directional controllably conductive means comprises a triac having at least two main terminals and having an actual working blocking voltage less than the normal arc voltage of said remaining lamp whereby said triac conducts said arc current in a break-over mode to said remaining lamp for only a portion of each half cycle of alternating current.

10. An improved fluorescent lamp substitute for use in a lighting fixture, said fixture having a ballast circuit normally operable to energize plural fluorescent lamps to produce respective normal lumen outputs at respective arc currents, having respective pairs of lampholders in which terminals of respective lamps may be situated for electrical connection and for mechanical support of said lamps, and having lampholder wires connecting said lampholders to said ballast circuit, the improvement comprising a bi-directional controllably conductive means for completing at least a portion of said ballast circuit when one of said lamps is removed therefrom thereby enabling said ballast circuit to energize at least one remaining lamp in circuit connection therewith, said bi-directional controllably conductive means limiting said arc current through said remaining lamp to substantially normal effective values to produce substantially normal lumen output of said remaining lamp in order to promote normal lamp life and normal ballast life, said lamp substitute being electrically connectable to said lampholder wires of said lampholders of said removed lamp.

11. The improvement of claim 10 wherein said bi-directional controllably conductive means comprises a triac having at least two main terminals and having gating means whereby said triac reacts to increasing voltage each half cycle of alternating current to conduct said arc current through said remaining lamp for only a portion of said half cycle.

12. The improvement of claim 11 wherein said gating means comprises a resistor connected to the gate terminal and one of said main terminals of said triac.

13. The improvement of claim 11 wherein said gating means comprises a capacitor connected to the gate terminal and one of said main terminals of said triac.

14. The improvement of claim 11 wherein said gating means comprises an inductor connected to the gate terminal and one of said main terminals of said triac.

15. The improvement of claim 10 wherein said bi-directional controllably conductive means comprises a triac having at least two main terminals and having an actual working blocking voltage less than the normal arc voltage of said remaining lamp whereby said triac conducts said arc current in a break-over mode to said remaining lamp for only a portion of each half cycle of alternating current.

16. The improvement of claim 10 wherein said lamp substitute comprises a bi-directional controllably conductive means, wires with connections to at least two terminals of said means, electrical insulation material covering said controllably conductive means and said wire connections, said wires being extendable to electrically connect to said lampholder wires of said lampholders of said removed lamp.

17. The improvement of claim 1 wherein said lighting fixture and said fluorescent lamps comprise the rapid start type wherein each lamp includes electrically resistance heated cathodes.

18. The improvement of claim 10 wherein said lighting fixture and said fluorescent lamps comprise the rapid start type wherein each lamp includes elecrically resistance heated cathodes.

19. The improvement of claim 1 wherein said lighting fixture and said fluorescent lamps comprise the instant start type wherein each said lamp includes cold cathodes.

20. The improvement of claim 10 wherein said lighting fixture and said fluorescent lamps comprise the instant start type wherein each said lamp includes cold cathodes.

* * * * *